US006698102B2

(12) United States Patent
Mangiapane et al.

(10) Patent No.: US 6,698,102 B2
(45) Date of Patent: Mar. 2, 2004

(54) UNIVERSAL NECKTIE TYING AID AND TIES UTILIZING SAME

(76) Inventors: Salvatore Mangiapane, R.D. #1 Box Fombell, PA (US) 16123; Elizabeth Mangiapane, R.D. #1 Box Fombell, PA (US) 16123

( * ) Notice: Subject to any disclaimer, the term of this patent is extended or adjusted under 35 U.S.C. 154(b) by 128 days.

(21) Appl. No.: 09/837,798

(22) Filed: Apr. 18, 2001

(65) Prior Publication Data

US 2001/0039743 A1 Nov. 15, 2001

Related U.S. Application Data

(63) Continuation-in-part of application No. 09/243,773, filed on Feb. 3, 1999, now abandoned.

(51) Int. Cl.[7] ..... A41H 1/00
(52) U.S. Cl. ..... 33/562; 33/2 R
(58) Field of Search ..... 33/2 R, 17 R, 33/511, 512, 613, 645, 562, 563, 566

(56) References Cited

U.S. PATENT DOCUMENTS

| | | | | | |
|---|---|---|---|---|---|
| 2,148,154 | A | * | 2/1939 | Garfinkle | 2/146 |
| 3,571,935 | A | * | 3/1971 | Van Wye | 2/146 |
| 3,747,220 | A | * | 7/1973 | Weisnicht | 2/146 |
| 4,682,419 | A | * | 7/1987 | Lynch | 33/613 |
| 4,845,857 | A | * | 7/1989 | Klosterman | 33/485 |
| 5,105,553 | A | * | 4/1992 | Weston | 2/146 |
| 5,505,002 | A | * | 4/1996 | Falco | 2/144 |

* cited by examiner

*Primary Examiner*—Diego Gutierrez
*Assistant Examiner*—Tania Courson
(74) *Attorney, Agent, or Firm*—John D. Gugliotta; P. Jeffmartin

(57) ABSTRACT

An adaptable neck tie tying method and template system are provided that can be customized to individual users, incorporated into the tie itself, as well as transferred from tie to tie.

11 Claims, 6 Drawing Sheets

UNIVERSAL NECKTIE TYING AID AND TIES UTILIZING SAME

RELATED APPLICATIONS AND DISCLOSURES

The present invention is a Continuation in Part of U.S. application No. 09/243,773, filed on Feb. 3, 1999, and now abandoned.

BACKGROUND OF THE INVENTION

1. Field of the Invention

The present invention relates generally to necktie tying assistance devices and, more particularly, to a universal necktie tying aid and ties utilizing same.

2. Description of the Related Art

The ever changing world of fashion is constantly producing new designs, incorporating new styles and utilizing materials in a manner which results in new "looks" that engulf our increasingly fashion conscious society, forming trends followed by millions. However, when it comes to business and formal wear, the classic look and style of the suit and tie has remained relatively constant.

In keeping with this tradional look, men have struggled with an age-old problem in that it is difficult to estimate the proper length at which to tie a knot in a necktie. As a result, one must go through several iterations of tying the knot in order to achieve the appropriate resulting length.

Accordingly, there is a need for a means by which one can quickly and easily tie the knot in a necktie at the correct length the first time, eliminating the trial and error method to which we have become accustomed.

There exists many references that attempt to overcome these problems. Such references can generally be categorized into two major categories: those that are knot independent which have no methodology, other than trial and error, for gauge or marking placement (e.g. Garfinke 2, 148, 154; Light 3,335,426; and Weston 5,105,553); and, those which precisely determine gauge or marking placement which are specifically engineered for each knot described (e.g. Weishicht 3,747,220; Shart 2,994,886; and Van Wye 3,571,935)

The present invention has overcome these limitations and provides a methodology for specific placement of a knot independent marking system. The limitations have been overcome by incorporating, into the design, a precise methodology for placement of the marking system and including the action of tying a knot in the nectie to determine the specific mark required.

SUMMARY OF THE INVENTION

It is therefore an object of the present invention to provide an improved universal necktie tying aid and ties utilizing same that allows a user to tie the correct length tie the first time, regardless of the type of knot used or the thickness of the tie.

Briefly described according to one embodiment of the present invention, a universal necktie tying aid and ties utilizing same is disclosed, designed to eliminate the need to guess the correct position of a tie prior to tying to ensure a tie tied to the perfect length. The present invention consists of a template, which ties like a regular tie. After the template has been put on, proper tie length for use as a reference point in the future can be determined. The present invention accomplishes this by providing a generic knot starting point and a series of reference marks, located on the front side of the template, along its length, that serve as a gauge by which the wearer can determine the proper positioning every time.

The user simply ties the template in a conventional manner in order to determine the proper length for a person of his size. Then, he systematically records the marking that corresponds with his size and uses the template to mark the back side of his traditional ties, allowing him to tie the knot on his tie at the same point every time. By doing so, the wearer eliminates the guesswork in wearing the necktie, producing the proper length every time and on the first try. The marking system is also available as an original feature on new ties.

It is another object of the present invention to provide a template that is knot type independent, thus allowing the template to be used to determine proper beginning position for a variety of knots.

It is another object of the present invention to provide one series of markings for a variety of knots, thus permitting the user to tie any type of desired knot correctly the first time.

It is another object of the present invention to provide a device that ensures proper tie length, customized to the individual. This eliminates the guesswork of tying a tie, reduces wear on the tie due to retying of the tie to obtain proper length, and saves time.

It is another object of the present invention to provide one series of markings for a variety of tie material (e.g. silk, wool, knit) and widths and thicknesses (differing weight of backing), thus permitting the user to have one size regardless of the tie. This applies to this system used as an original feature on new ties.

It is another object of the present invention to provide a kit that allows a user to correctly tie existing ties, the first time.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 4*b*.

1. Detailed Description of the Figures

Figure 1:
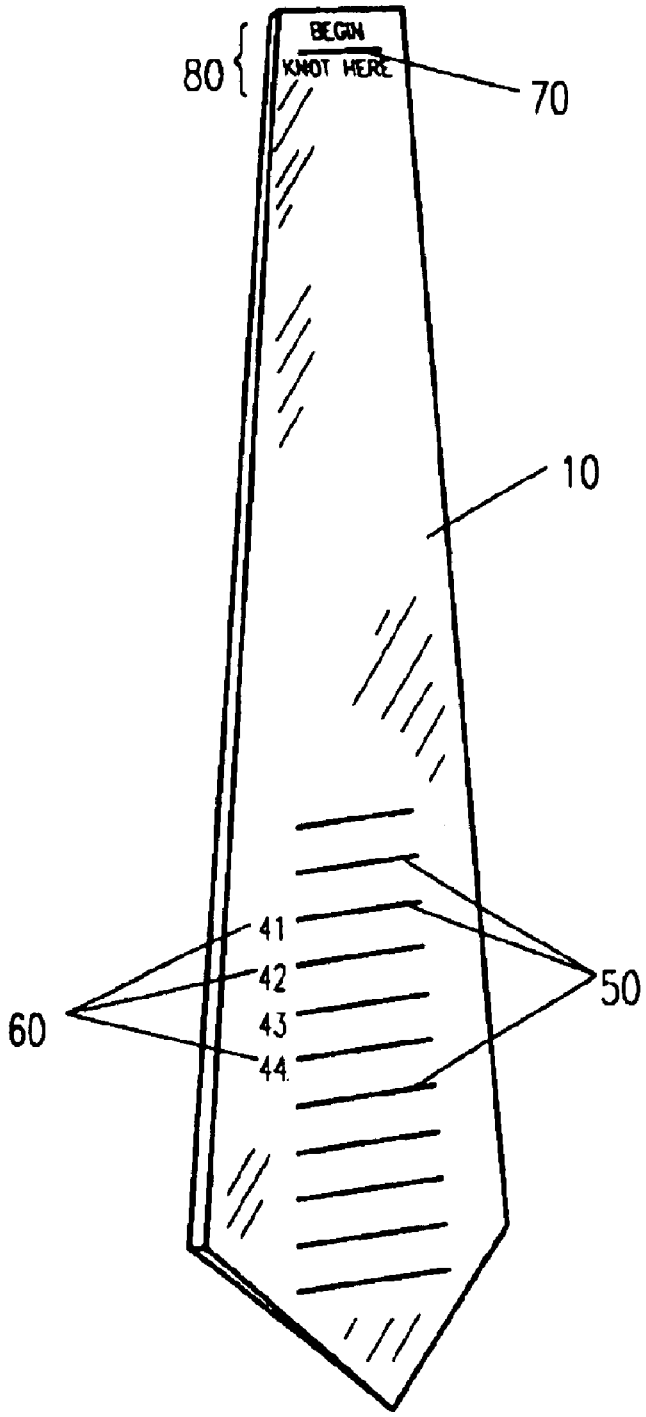
FIG. 1 is a front perspective view of the preferred embodiment of universal necktie tying aid and ties utilizing same 10.
Figure 2:
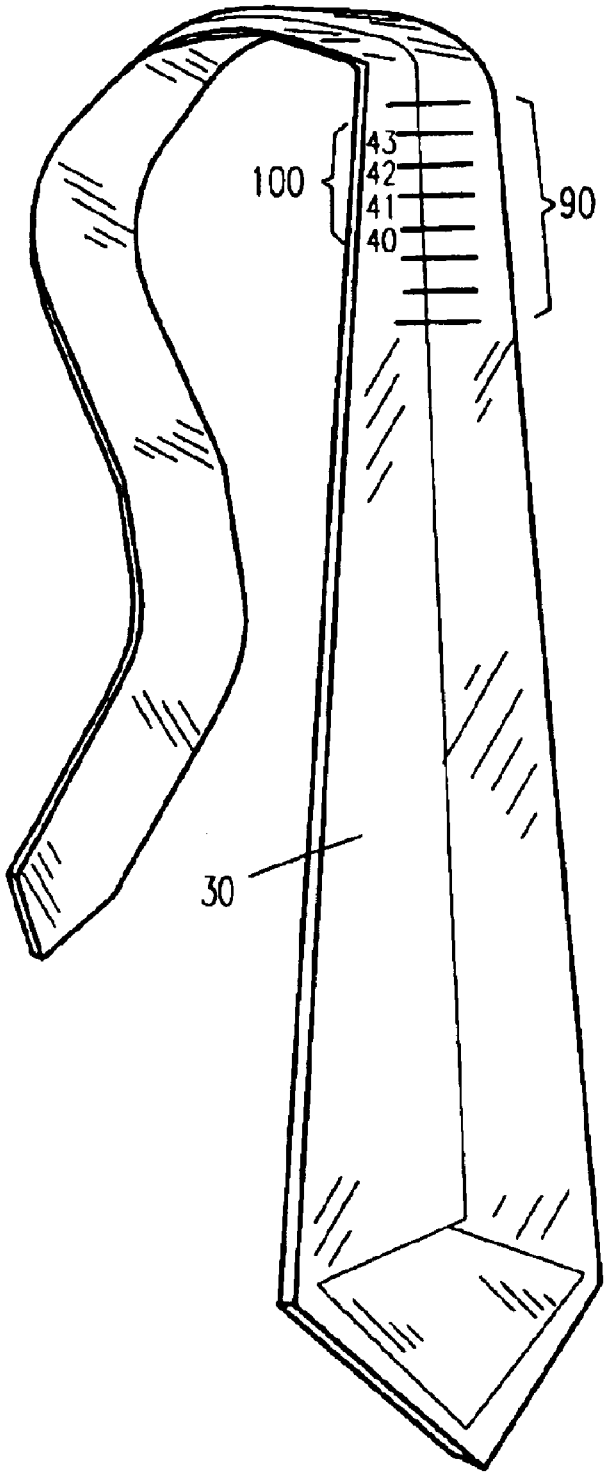
FIG. 2 is a rear view of a tie incorporating the marking system 30 of the present invention.

Referring now to FIG. 1, a universal necktie tying aid and ties utilizing same 10 is shown, according to the present invention, designed to eliminate the need to guess the correct position of a tie 20 (not shown in FIG. 1) prior to tying to ensure a perfectly tied tie 20. The present invention provides a method, after the present invention has been put on, to denote proper knot origination of a tie 20 length for use as a reference point in the future.

The present invention comprises a template 10 which is used to determine the correct position at which a tie 20 should be positioned to ensure a proper fit, adjusted for the torso and particular knot of each individual user. As such, the present invention is universal in application, capable of use by users of varying sizes. Each individual will ascertain the correct starting position to tie a particular knot and tie 20 using the present invention.

The template 10 is configured to resemble a conventional tie 20, with a series of lower reference marks 50, equally spaced, laterally extending, and vertically stacked along the elongated centerline of the template 10. The lower reference marks 50 are located on the front of the template 10, starting at the lower, bottom portion of the template 10, and stacked upward toward the upper end. Lower reference mark indicia 60 are used to identify each lower reference mark 50. The lower reference mark indicia 60 is selected from the group consisting of centimeters, inches, or simply letters. For the purposes of this disclosure and by way of example only, the lower reference mark indicia 60 is indicated in centimeters.

A knot origination reference mark 70 is positioned above the lower reference marks 50. Knot origination indicia 80, such as the words "begin knot here" are used to identify the knot origination reference mark 70. The lower reference mark indicia 60 indicates the distance of the template 10 between each lower reference mark 50 and knot origination reference mark 70 once a certain type of knot is tied. The distance between the knot origination reference mark 70 and the closest lower reference mark 50 (as indicated by the corresponding lower reference mark indicia 60) should be approximately thirteen (13) inches or equivalent to the trunk length of a short man after a particular small knot is tied.

The lower reference marks 50 would continue with each lower, lower reference mark 50 being farther away from the knot origination reference mark 70. The distance of the lowest lower reference mark 50 (as indicated by the corresponding lower reference mark indicia 60) should be approximately thirteen (13) inches or equal to the trunk length of a very tall man, after tying a particular large knot, so as to ensure that all individuals could use the template 10.

For purposes of disclosure, the lower reference marks 50 are spaced to indicate the distance each lower reference mark 50 is from a tied Shelby knot started with the upper part of the template 10 crossing over the template 10 at the knot origination reference mark 70.

The spacing of the lower reference marks 50 and their relation to their distance from the knot origination reference mark 70 may be varied to any consistently numbered system.

It is envisioned that the lower reference marks 50 and lower reference mark indicia 60 and knot origination reference mark 70 and knot origination indicia 80 can be on either the front or back of the template 10.

The number discovered on the template 10 while using the template 10 is used to mark traditional neckties 20. To mark a traditional necktie 20, the user will align the wide tip of the tie 20 with the appropriate lower reference mark 50 (as indicated by the corresponding lower reference mark indicia 60). Then, the knot origination reference mark 70 is marked on the tie 20. The user may then tie a knot at the mark on tie 20, which will result in a tie duplicated to match the template 10.

The template 10 can be used to obtain a lower reference mark indicia 60 for a variety of knot styles tied. The operator would then simply remember the lower reference mark indicia 60 that corresponds to each type of knot tied. For example, the user may be a 45 in a half Windsor and a 54 in a full Windsor.

Figure 4A:
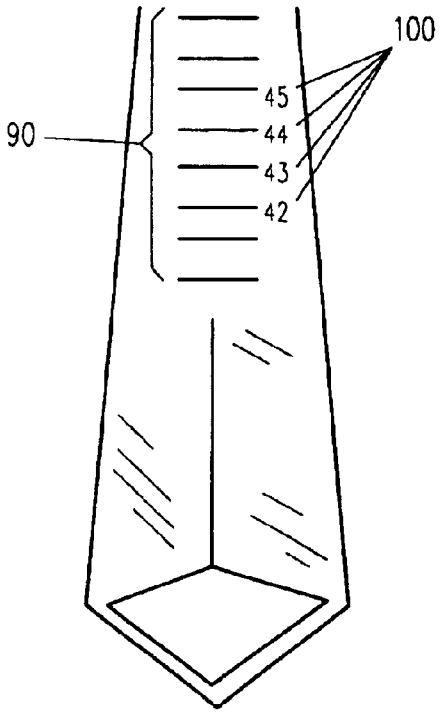
FIGS. 4*a* & 4*b* are a series of perspective views showing how to use a tie incorporating the marking system 30 of the present invention.
Figure 4B:
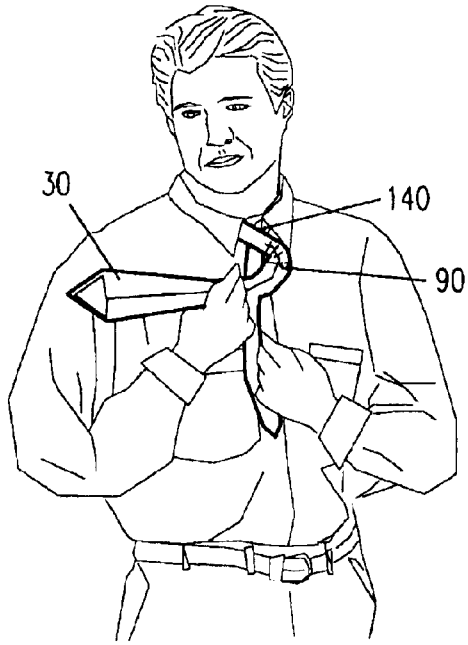

Referring now to FIGS. 4*a* and 4*b*, in an alternate embodiment of the present invention, a tie incorporating a reference mark system 30 is disclosed. A series of upper reference marks 90 are equally spaced, laterally extending, and vertically stacked along the elongated centerline of the tie incorporating the reference mark system 30. The upper reference marks 90 are located on the back of the tie incorporating the reference mark.

Upper reference mark indicia 100 are used to identify each upper reference mark 90. The upper reference mark indicia 100 may be in centimeters, inches, or simply letters. The upper reference mark indicia 100 correspond to the lower reference mark indicia 60. The distance each upper reference mark 90 is from the bottom of the tie incorporating the reference mark system 30 is proportional to the lower reference marks 50 discovered on the template 10, with the knot origination mark 70 on the template 10.

For example, if a person discovered they were a 42 on the template 10, then the 42 located on the tie incorporating the reference mark system 30 would be located so that when that particular knot is started at this position, the tie incorporating the reference mark system 30 bottom would rest at the desired location.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

Figure 3A:
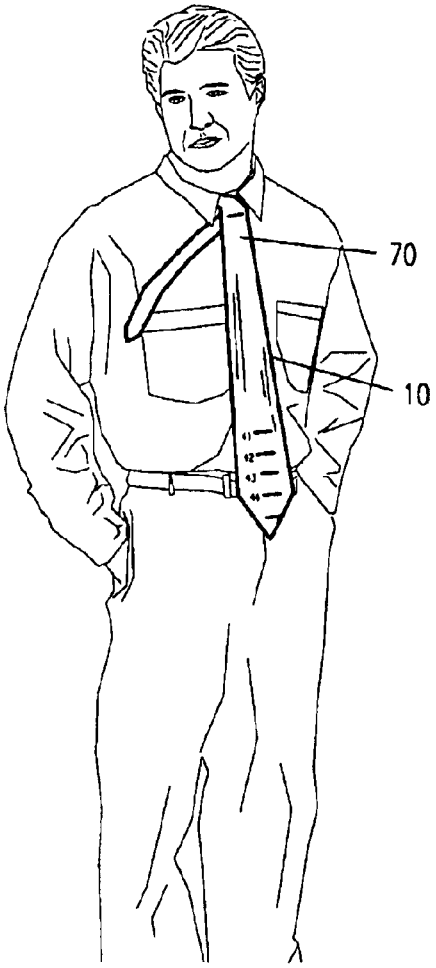
FIGS. 3*a*–3*f* are a series of perspective views showing how to tie a tie using the template 10 and a traditional tie 20.

Referring now to FIG. 3*a*, to use the present invention, the operator simply decides which knot to tie, using the template 10. The operator then ties the knot starting with the template 10 wrapped over itself and intersecting at the knot origination reference mark 70.

Figure 3B:
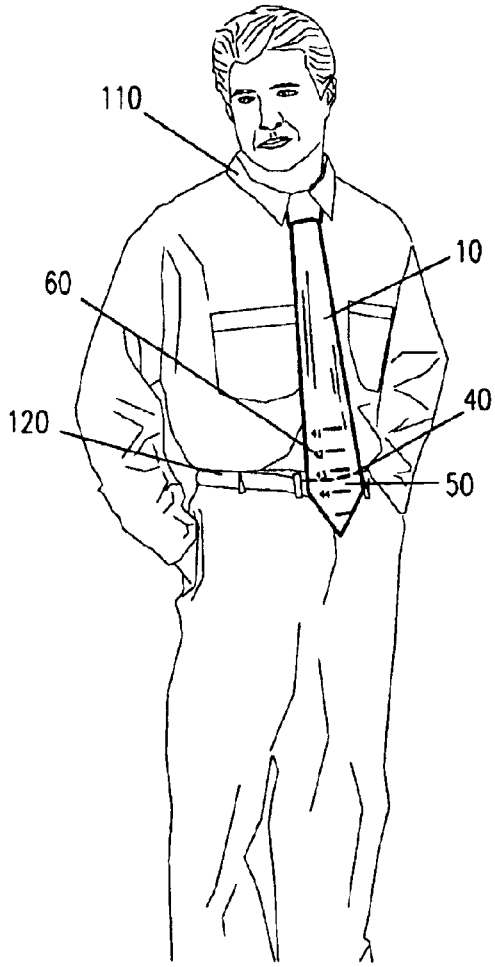

Referring now to FIG. 3*b*, the template 10 is positioned to the collar 110 Next, the operator notes the lower reference mark indicia 60 that corresponds to the position of a properly tied tie 40. For instance, if the operator wears tie 20 above his belt 120, he would note the lower reference mark indicia 60 that corresponds to that position as the position of a properly tied tie 40.

Figure 3C:
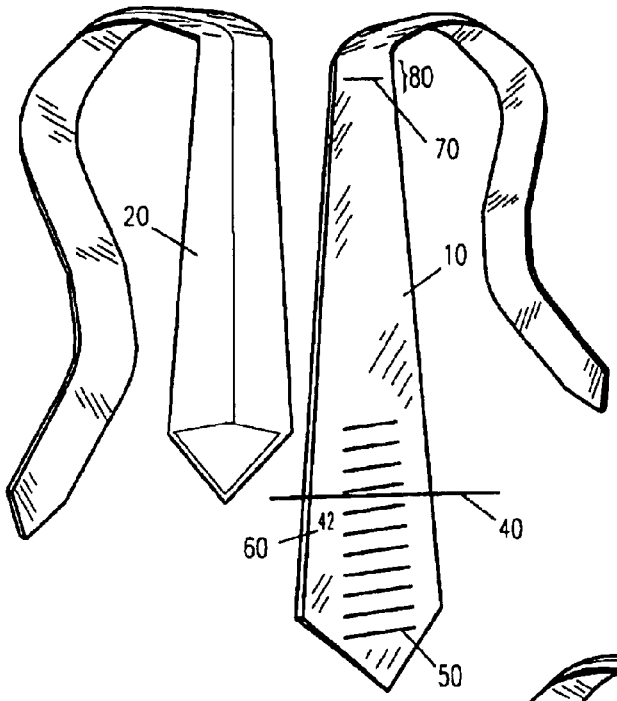

Referring now to FIG. 3*c*, the operator next uses that lower reference mark indicia 60 for the position of a properly tied tie 40 to mark the traditional ties 20. To do this, the operator takes off the template 10 and lays the template 10 flat on any surface, with lower reference marks 50 facing upward. Each traditional tie 20 to be marked is placed, one at a time, back side up on top of the template 10, such that the back side of the traditional tie 20 is facing upward and the tip of the traditional tie 20 positioned on the lower reference mark 50 noted above.

Figure 3D:
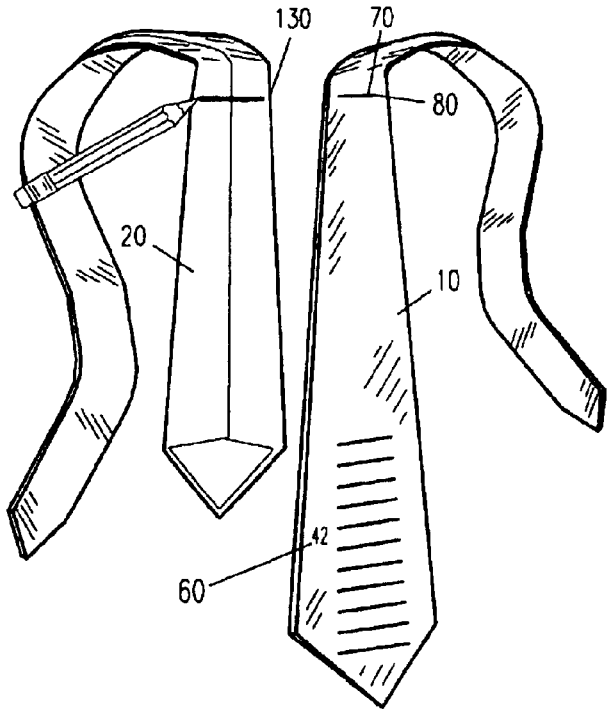

Referring now to FIG. 3*d*, next, mark the traditional tie 20 at the hand marked position 130 that corresponds to the position of the knot origination reference mark 70 on the template 10 located underneath the traditional tie 20.

Figure 3E:
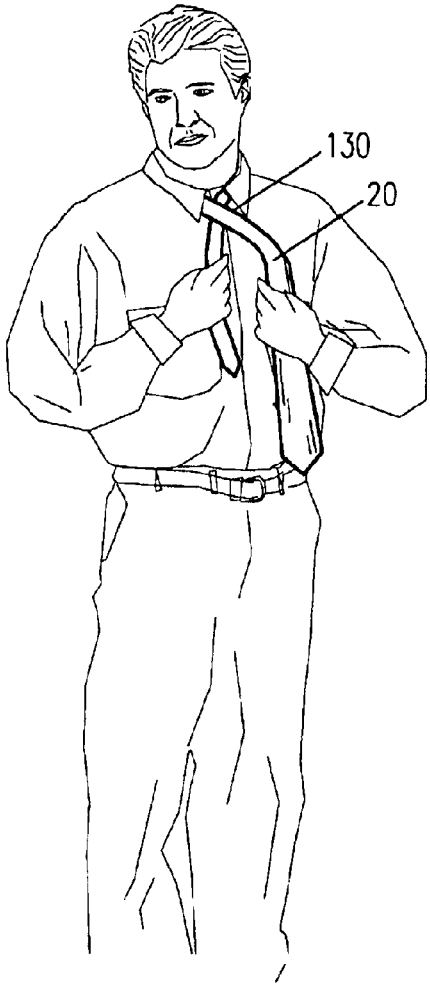
PRIOR ART Figure 3e
Figure 3F:
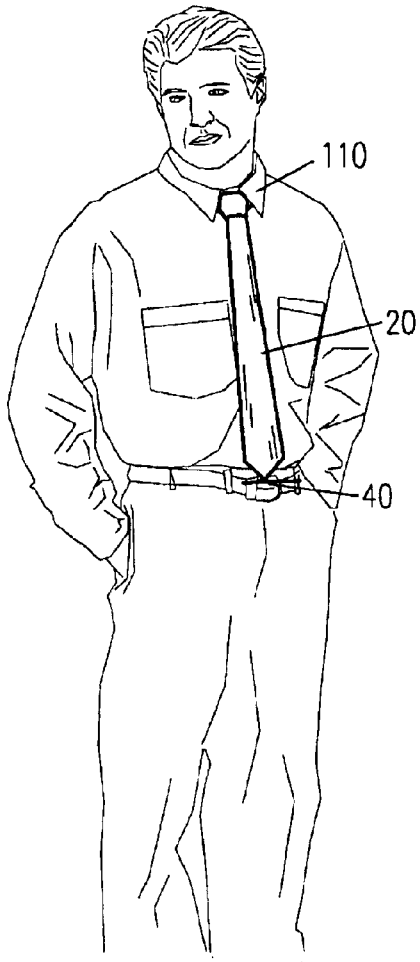
PRIOR ART Figure 3f

Referring now to FIGS. 3*e* and 3*f*, when the operator wishes to wear that tie 20, the operator simply starts the tie 20 by crossing over the tie 20 at the hand marked position 130, and obtains a tied tie 20 of the correct length each time.

Referring now to FIGS. 4*a* and 4*b*, in an alternate embodiment of the present invention, a tie incorporating a reference mark system 30 is disclosed. A series of upper reference marks 90 are equally spaced, laterally extending, and vertically stacked along the elongated centerline of the tie incorporating the reference mark system 30. The upper reference marks 90 are located on the back of the tie incorporating the reference mark.

The foregoing description is included to illustrate the operation of the preferred embodiment and is not meant to limit the scope of the invention. The scope of the invention is to be limited only by the following claims.

What is claimed is:

1. A universal necktie tying aid consisting:

a template, said template configured to resemble a tie;

a series of lower reference marks, equally spaced, laterally extending, and vertically stacked along an elongated centerline of said template;

lower reference mark indicia, said lower reference mark indicia located adjacent to each of said lower reference marks, and said lower reference mark indicia used to identify each of said lower reference marks;

having only one knot origination reference mark, said knot origination reference mark positioned above said lower reference marks; and knot origination indicia, said knot origination indicia positioned parallel to and just above and below said knot origination reference mark, and said knot origination indicia used to identify said knot origination reference mark.

2. The universal necktie tying aid described in claim 1, wherein said lower reference marks are located on a front of said template, starting at a wide, bottom portion of said template, and stacked upward toward a smaller width end.

3. The universal necktie tying aid described in claim 1, wherein said lower reference mark indicia is selected from the group consisting of centimeters, inches, or letters.

4. The universal necktie tying aid described in claim 1, wherein said lower reference mark indicia indicate a distance each lower reference mark is from said knot origination reference mark once a certain type of knot is tied.

5. The universal necktie tying aid of claim 4, wherein said lower reference marks are spaced to indicate said distance each of said lower reference mark is from a tied Shelby knot stoned with an upper part of said template crossing over said template at said knot origination reference mark.

6. The universal necktie tying aid of claim 1, wherein said template is used to mark neckties.

7. A method for marking a traditional tie using the necktie tying aid of claim 6, the method comprising the steps of:

first, an operator decides which knot to tie, using said template;

second, operator then ties said knot starting with said template wrapped over itself and intersecting at said knot origination reference mark;

third, said template is positioned to a collar of the operator;

fourth, the operator notes said template lower reference mark that corresponds to a position the operator would like a bottom of the operator's tie to be placed;

fifth, the operator uses a corresponding said template lower reference mark obtained in step four to mark operator's traditional ties by taking off said template and laying said template flat on any surface, with lower reference marks facing upward; and sixth, each traditional tie to be marked is placed, one at a time, back side up on top of said template, such that a back side of said traditional tie is facing upward and a tip of said traditional tie is positioned on said lower reference mark.

8. A universal necktie tying aid of claim 1, wherein said lower reference marks correspond to upper reference marks and said lower reference mark indicia correspond to upper reference mark indicia being incorporated into the design of a necktie.

9. The universal necktie tying aid described in claim 8, wherein said upper reference marks are located on the back of said necktie; said upper reference marks are equally spaced, laterally extending, and vertically stacked along an elongated centerline of said tie incorporating said reference mark system.

10. The universal necktie tying aid described in claim 8, wherein said upper reference mark indicia is selected from the group consisting of centimeters, inches, or letters.

11. The universal necktie tying aid described in claim 8, wherein said upper reference mark indicia indicate the distance each upper reference mark is from the bottom wide end of said necktie once a certain type of knot is tied.

* * * * *